US009038587B2

(12) United States Patent
Yoon et al.

(10) Patent No.: US 9,038,587 B2
(45) Date of Patent: May 26, 2015

(54) VARIABLE VALVE LIFT DEVICE

(71) Applicants: Hyundai Motor Company, Seoul (KR); Kia Motors Corporation, Seoul (KR)

(72) Inventors: Seock Joong Yoon, Whasung-Si (KR); Kyung Mo Kim, Whasung-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 13/874,816

(22) Filed: May 1, 2013

(65) Prior Publication Data

US 2014/0165941 A1 Jun. 19, 2014

(30) Foreign Application Priority Data

Dec. 17, 2012 (KR) ..... 10-2012-0147818

(51) Int. Cl.

| | |
|---|---|
| ***F01L 1/18*** | (2006.01) |
| ***F01L 13/00*** | (2006.01) |
| ***F01L 1/26*** | (2006.01) |

(52) U.S. Cl.

CPC ..... *F01L 13/0015* (2013.01); *F01L 1/26* (2013.01); *F01L 13/0005* (2013.01)

(58) Field of Classification Search

CPC ..... F01L 1/26; F01L 13/06
USPC ..... 123/90.22, 321, 90.39–90.47
See application file for complete search history.

(56) References Cited

U.S. PATENT DOCUMENTS

| | | | | |
|---|---|---|---|---|
| 2005/0211206 | A1 * | 9/2005 | Ruggiero et al. | 123/90.16 |
| 2012/0132162 | A1 | 5/2012 | Yoon et al. | |
| 2013/0098319 | A1 * | 4/2013 | Methley et al. | 123/90.12 |

FOREIGN PATENT DOCUMENTS

KR 10-2012-0058145 A 6/2012

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve lift apparatus may include a rocker arm coupled with a rocker arm shaft, a valve bridge disposed to be pressed by one end portion of the rocker arm, the valve bridge including a piston insertion hole and at least one pin insertion hole connecting to the piston insertion hole, a valve disposed to be pressed by the valve bridge, and a variable lift unit disposed in the valve bridge and variably controlling an amount that the rocker arm presses the valve bridge. The variable lift unit includes a variable piston of which the lower portion is inserted into the piston insertion hole, and a check pin disposed in the pin insertion hole to be selectively inserted into the pin groove formed on a side surface of the variable piston according to the hydraulic pressure supplied to the piston oil passage formed in the variable piston.

9 Claims, 8 Drawing Sheets

Section A-A

Section B-B

VARIABLE VALVE LIFT DEVICE

CROSS-REFERENCE TO RELATED APPLICATION

The present application claims priority of Korean Patent Application Number 10-2012-0147818 filed Dec. 17, 2012, the entire contents of which application is incorporated herein for all purposes by this reference.

BACKGROUND OF INVENTION

1. Field of Invention

The present invention relates to a valve lift device. More particularly, the present invention relates to a variable valve lift apparatus that variably controls a lift amount of a valve opening/closing an intake port or an exhaust port of an internal combustion engine in multi steps.

2. Description of Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine.

In order to achieve such an optimal valve operation depending on the rotation speed of the engine, research has been undertaken on a variable valve lift (VVL) apparatus that enables different valve lifts depending on the engine speed.

Meanwhile, a rocker arm is disposed on a rocker arm shaft, a cam that is disposed at one side of the rocker arm is used to lift a valve that is disposed at the other side of the rocker arm, a structure/method variably controlling the lift amount of the valve has been researched, and particularly a variable valve lift apparatus that has a simple structure and is easily assembled has been being researched.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present disclosure has been made in an effort to provide a valve lift apparatus having advantages of reducing fuel consumption and noise/vibration by variably operating a valve in a high lift or a low lift through a simple structure.

A variable valve lift apparatus according to various aspects of the present disclosure may include a rocker arm coupled with a rocker arm shaft, a valve bridge disposed to be pressed by one end portion of the rocker arm, wherein the valve bridge includes a piston insertion hole that is open upward and at least one pin insertion hole that connects to the piston insertion hole in a lengthwise direction of the valve bridge, a valve disposed to be pressed by the valve bridge, and a variable lift unit disposed in the valve bridge and variably controlling an amount that the rocker arm presses the valve bridge. The variable lift unit may include a variable piston of which the lower portion is inserted into the piston insertion hole, wherein a pin groove is formed on a side surface of the variable piston corresponding to the pin insertion hole, and a piston oil passage that is connected to the pin groove is formed in the variable piston to selectively receive a hydraulic pressure from the rocker arm, and a check pin disposed in the pin insertion hole to be selectively inserted into the pin groove of the variable piston according to the hydraulic pressure that is supplied to the piston oil passage.

The variable valve lift apparatus may further include a pin elastic member that elastically supports the check pin such that a front end portion of the check pin is inserted into the pin groove and a return elastic member that elastically supports the variable pin upward.

Hydraulic pressure may be selectively supplied to the piston oil passage through a shaft oil passage that is formed substantially along an interior central portion of the rocker arm shaft and a shaft variable oil passage that is formed in the rocker arm.

The variable valve lift apparatus may further include a press bolt that is engaged with one end portion of the rocker arm and a lower end portion thereof faces an upper end portion of the variable piston and a bolt cap that is engaged with a lower end portion of the press bolt to press the upper end portion of the variable piston, wherein a bolt oil passage and a cap oil passage are formed in the press bolt and the cap, respectively, to connect the shaft variable oil passage with the piston oil passage.

The pin insertion hole may have an inlet that is open to an outside of the valve bridge and a hole cap closes the inlet and supports the pin elastic member.

A guide groove may be formed at a side surface of the variable piston, and a guide pin of which a front end portion may be inserted into the guide groove to guide a movement of the variable piston along the guide groove, wherein the guide pin may be fixed in the valve bridge.

An exhaust hole may be formed such that a space that the return elastic member is disposed is connected to the outside.

The at least one pin insertion hole may include two pin insertion holes, each disposed at one side of the piston insertion hole in a lengthwise direction of the valve bridge.

The variable valve lift apparatus may further include a rocker arm elastic member that elastically supports the rocker arm such that one end portion of the rocker arm presses the valve bridge, wherein the rocker arm elastic member is a plate spring or a type of a plate spring, and one end thereof is fixed on the rocker arm shaft and the other end thereof elastically supports one end portion of the rocker arm shaft toward the valve bridge.

The pin elastic member and the return elastic member may be coil springs or types of coil springs.

As described above, a variable valve lift apparatus according to various aspects of the present disclosure forms a variable lift unit in a valve bridge to make overall structure simple, and hydraulic pressure is selectively supplied to a variable lift unit that is configured in a valve bridge through a rocker arm shaft and a rocker arm to be able to operate a valve in a high lift or a low lift mode.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
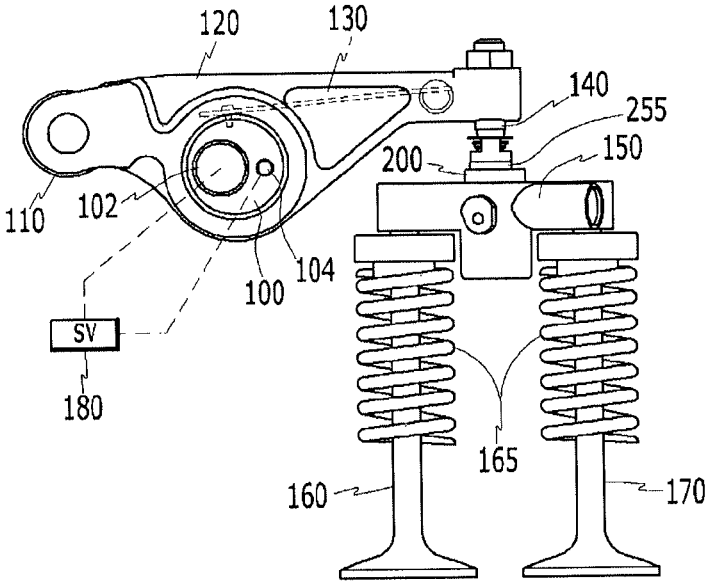
FIG. 1 is a side view of an exemplary variable valve lift apparatus according to the present disclosure.

FIG. 1 is a side view of an exemplary variable valve lift apparatus according to the present disclosure. Referring to FIG. 1, a variable valve lift apparatus includes a rocker arm shaft 100, a rocker arm 120, a roller 110, a solenoid valve 180, a rocker arm elastic member 130, a press bolt 140, a bolt cap 255, a variable piston 200, a valve bridge 150, a valve spring 165, and a first and second valves 160 and 170.

The rocker arm shaft 100 penetrates substantially across a central portion of the rocker arm 120, and a press bolt 140 penetrates one end portion of the rocker arm 120 in a lower direction to be fixed thereon.

The bolt cap 255 is fixed on a lower end portion of the press bolt 140, and a lower end portion of the bolt cap 255 contacts an upper portion of the variable piston 200. The variable piston 200 is inserted into an upper portion of the valve bridge 150.

Further, both sides of the lower portion of the valve bridge 150 are supported by the first and second valves 160 and 170, and the valve spring 165 elastically supports the first and second valves 160 and 170 in an upper direction.

One side of the rocker arm elastic member 130 is fixed on the rocker arm shaft 100 and the other side thereof elastically supports one end portion of the rocker arm 120 in a lower direction.

The solenoid valve 180 selectively supplies a rocker arm main passage 102 or a shaft variable passage 104 that is formed in the rocker arm shaft 100 with hydraulic pressure, and the roller 110 contacts an output cam (non-illustrated) to rotate the rocker arm 120 on the rocker arm shaft 100.

Figure 2:
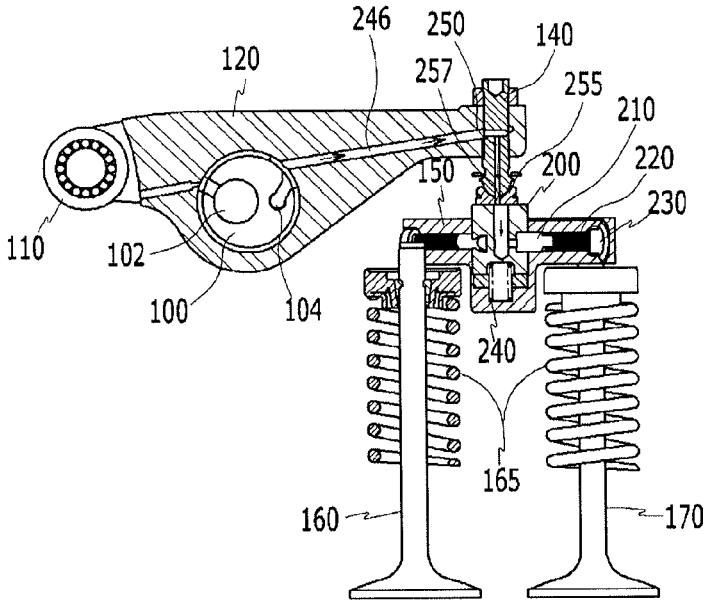
FIG. 2 is a cross-sectional side view of an exemplary variable valve lift apparatus according to the present disclosure.

FIG. 2 is a cross-sectional side view of an exemplary variable valve lift apparatus according to the present disclosure. Referring to FIG. 2, a rocker arm passage 246 that is connected to the shaft variable passage 104 is formed in the rocker arm 120, and a bolt passage 250 that is connected to the rocker arm passage 246 is formed in the press bolt 140. Further, a cap passage 257 that is connected to the bolt passage 250 is formed in the bolt cap 255.

A variable lift unit according to various embodiments of the present disclosure includes a variable piston 200, a check pin 210, a pin elastic member 220, a hole cap 230, and a return elastic member 240.

Figure 3A:
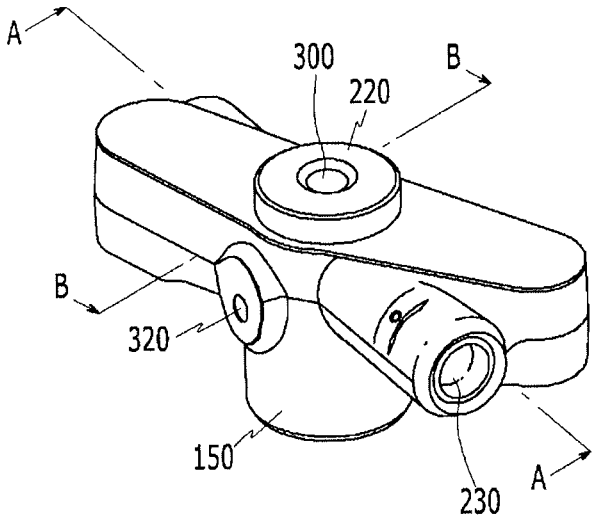
FIG. 3A is a perspective view of an exemplary variable valve lift apparatus according to the present disclosure.

FIG. 3A is a perspective view of an exemplary variable valve lift apparatus according to the present disclosure. Referring to FIG. 3A, the variable piston 200 is inserted into a central portion of the upper portion of the valve bridge 150, and an upper end portion of the variable piston 200 protrudes in an upper direction.

A guide pin 320 is fixed on a side surface of the valve bridge 150, and a hole cap 230 is fixed at an end portion of a length direction of the valve bridge 150.

Figure 3B:
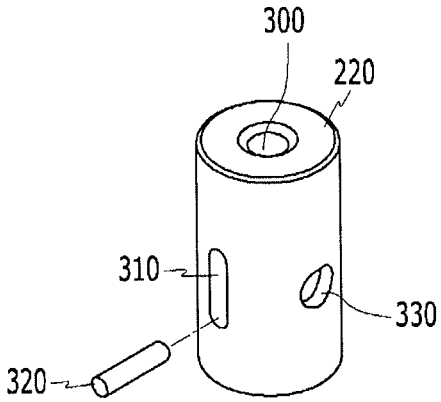
FIG. 3B is a partial exploded perspective view of an exemplary variable valve lift apparatus according to the present disclosure.

FIG. 3B is a partial exploded perspective view of an exemplary variable valve lift apparatus according to the present disclosure. Referring to FIG. 3B, a guide groove 310 that the front end portion of the guide pin 320 is inserted therein is formed at one side surface of the variable piston 200. A pin groove 330 is formed at the other side surface of the variable piston 200.

Figure 4:
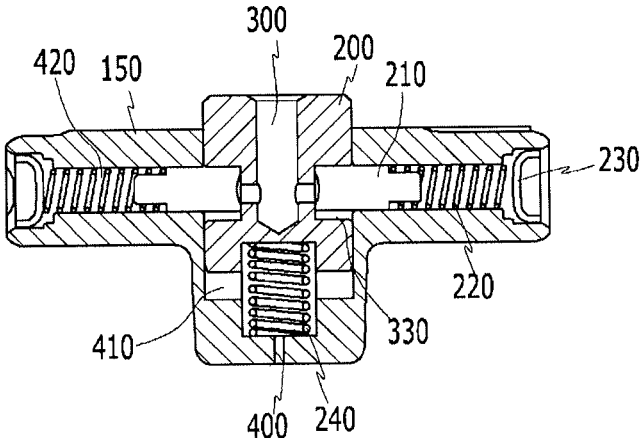
FIG. 4 is a partial cross-sectional view along A-A line of FIG. 3A.

FIG. 4 is a partial cross-sectional view along A-A line of FIG. 3A. Referring to FIG. 4, a piston insertion hole 410 that is opened toward an upper portion is formed on the valve bridge 150, and the variable piston 200 is moved from an upper side to a lower side to be inserted into the piston insertion hole 410.

The pin insertion hole 420 that is connected to the piston insertion hole 410 is formed at both sides of the inside of the valve bridge 150 across the piston insertion hole 410, and an inlet of the pin insertion hole 420 that is connected to an outside is closed by the hole cap 230.

A piston passage 300 is formed on the variable piston 200 from a central portion of an upper portion to a lower portion, and a pin groove 330 is formed at both sides of the variable piston 200 to correspond to the pin insertion hole 420.

A check pin 210 is inserted into the pin insertion hole 420, and the pin elastic member 220 elastically supports the check pin 210 toward the pin groove 330. Here, the hole cap 230 prevents that the pin elastic member 220 is separated from the valve bridge 150.

The piston passage 300 that is formed at a central portion of the variable piston 200 is connected to the pin groove 330. And, a return elastic member 240 is disposed at a lower portion of the variable piston 200 in the piston insertion hole 410, and the return elastic member 240 elastically supports the variable piston 200 in an upper direction. Further, an exhaust hole 400 that is connected to the piston insertion hole 410 is formed at a lower portion of the valve bridge 150.

Figure 5:
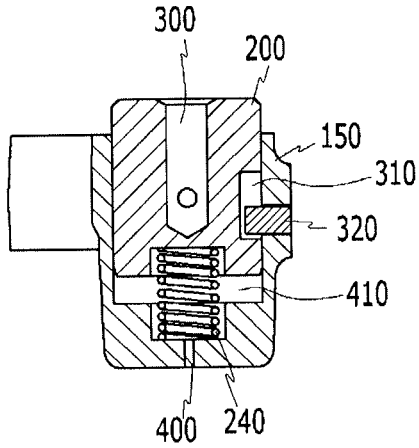
FIG. 5 is a partial cross-sectional view along B-B line of FIG. 3A.

FIG. 5 is a partial cross-sectional view along B-B line of FIG. 3A. Referring to FIG. 5, the variable piston 200 is inserted into the piston insertion hole 410 of the valve bridge 150, and the guide pin 320 is inserted into a side surface of the valve bridge 150. The guide pin 320 is fixed on the valve bridge 150, and the front end portion thereof is inserted into the guide groove 310 that is formed at a side surface of the variable piston 200.

The variable piston 200 is guided through a structure of the guide pin 320 and the guide groove 310, and the guide pin 320 prevents that the variable piston 200 is separated from the valve bridge 150.

Figure 6:
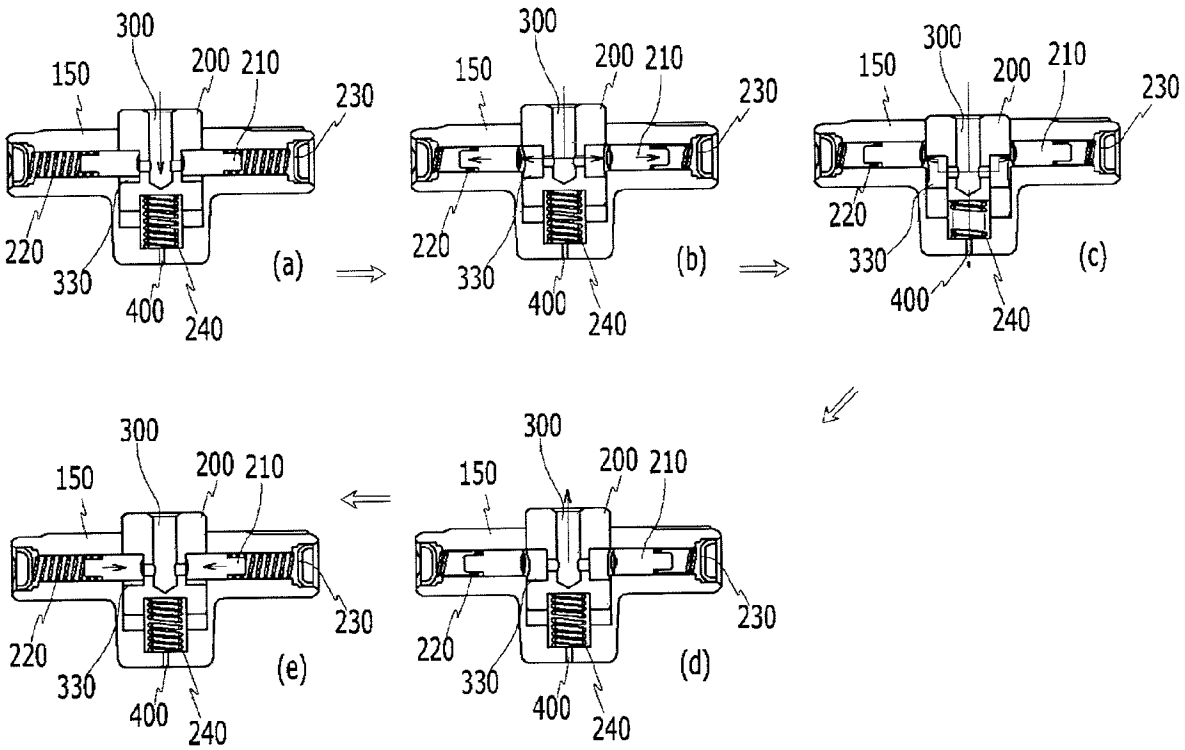
FIG. 6 is a partial cross-sectional view showing an operating procedure of an exemplary variable valve lift apparatus according to the present disclosure.

FIG. 6 is a partial cross-sectional view showing an operating procedure of an exemplary variable valve lift apparatus according to the present disclosure. In (a) of FIG. 6, a line hydraulic pressure is supplied through the shaft variable passage 104, the rocker arm passage 246, the bolt passage 250, the cap passage 257, and the piston passage 300 by the operation of the solenoid valve 180, and the hydraulic pressure that is supplied to the piston passage 300 is transmitted to the pin groove 330.

The hydraulic pressure that is transmitted to the pin groove 330 pushes the check pin 210 that is inserted into the pin groove 330 toward the outside to separate the check pin 210 from the pin groove 330. Accordingly, a state or stage like (b) of FIG. 6 is achieved.

In (b) of FIG. 6, if the rocker arm 120 pushes the variable piston 200, the variable piston 200 is inserted into an inner side of the piston insertion hole 410 of the valve bridge 150. And, while the variable piston 200 descends in a lower side, hydraulic pressure of the piston insertion hole 410 is exhausted to the outside through the exhaust hole 400.

If line hydraulic pressure is not supplied to the shaft variable passage 104 by the operation of the solenoid valve 180, as shown in (d) of FIG. 6, the variable piston 200 is ascended by the return elastic member 240.

And, as shown in (e) of FIG. 6, the pin elastic member 220 pushes the check pin 210 such that the front end portion of the check pin 210 is inserted into the pin groove 330 of the variable piston 200. Accordingly, although the rocker arm 120 pushes the variable piston 200, the variable piston 200 is not inserted into the piston insertion hole 410.

Figure 7:
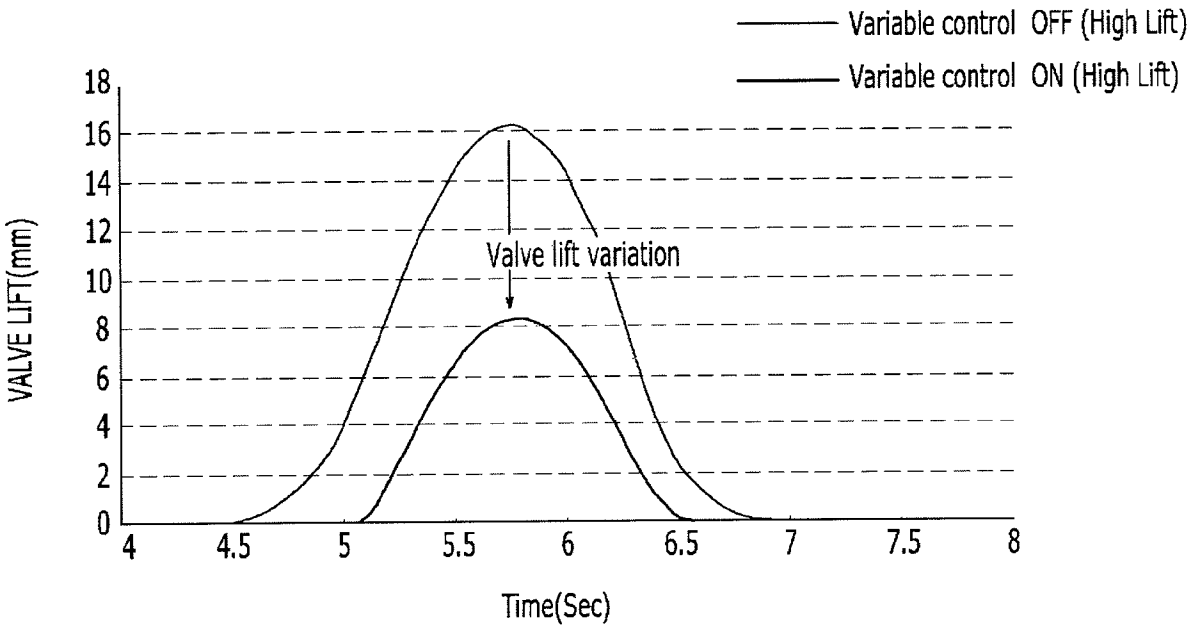
FIG. 7 is a graph showing an effectiveness of an exemplary variable valve lift apparatus according to the present disclosure.

FIG. 7 is a graph showing an effectiveness of an exemplary variable valve lift apparatus according to the present disclosure. Referring to FIG. 7, a horizontal axis denotes time, and a vertical axis denotes a lift amount of a valve. As shown in the drawings, if hydraulic pressure is supplied to the variable piston 200 by the operation of the solenoid valve 180, the valve is operated in a lower lift mode, and if hydraulic pressure is not supplied to the variable piston 200 by the operation of the solenoid valve 180, the valve is operated in a higher lift mode.

In various embodiments of the present disclosure, a variable lift unit is configured in a valve bridge 150 such that the unit can be direct applied to a valve lift layout, hydraulic pressure is direct supplied through a rocker arm 120 such that the hydraulic control becomes quick and accurate, and a high lift and a low lift is realized by one cam.

Further, a multi-step lift of a valve is realized by replacing a general valve bridge with new valve bridge, and therefore a development cost is reduced, standardization of components becomes easy, fuel consumption is reduced in a low load and a low RPM condition, and control responsiveness of engine can be improved.

For convenience in explanation and accurate definition in the appended claims, the terms "upper" or "lower", "front or rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus, comprising:

a rocker arm coupled with a rocker arm shaft;

a valve bridge disposed to be pressed by one end portion of the rocker arm, wherein the valve bridge includes a piston insertion hole that is open upward and at least one pin insertion hole that connects to the piston insertion hole in a lengthwise direction of the valve bridge;

a valve disposed to be pressed by the valve bridge;

a variable lift unit disposed in the valve bridge and variably controlling an amount that the rocker arm presses the valve bridge, wherein the variable lift unit includes:

a variable piston of which a lower portion is inserted into the piston insertion hole, wherein a pin groove is formed on a side surface of the variable piston corresponding to the pin insertion hole, and a piston oil passage that is connected to the pin groove is formed in the variable piston to selectively receive a hydraulic pressure from the rocker arm; and a check pin disposed in the pin insertion hole to be selectively inserted into the pin groove of the variable piston according to the hydraulic pressure that is supplied to the piston oil passage; and a rocker arm elastic member that elastically supports the rocker arm such that the one end portion of the rocker arm presses the valve bridge, wherein the rocker arm elastic member is a plate spring, and one end thereof is fixed on the rocker arm shaft and the other end thereof elastically supports one end portion of the rocker arm shaft toward the valve bridge.

2. The variable valve lift apparatus of claim 1, further comprising a pin elastic member that elastically supports the check pin such that a front end portion of the check pin is inserted into the pin groove and a return elastic member that elastically supports the variable pin upward.

3. The variable valve lift apparatus of claim 2, wherein an exhaust hole is formed such that a space that the return elastic member is disposed in is connected to an outside.

4. The variable valve lift apparatus of claim 2, wherein the pin elastic member and the return elastic member are coil springs.

5. The variable valve lift apparatus of claim 1, wherein the hydraulic pressure is selectively supplied to the piston oil passage through a shaft oil passage that is formed substantially along an interior central portion of the rocker arm shaft and a shaft variable oil passage that is formed in the rocker arm.

6. The variable valve lift apparatus of claim 5, further comprising:

a press bolt that is engaged with the one end portion of the rocker arm and a lower end portion thereof faces an upper end portion of the variable piston; and a bolt cap that is engaged with the lower end portion of the press bolt to press the upper end portion of the variable piston, wherein a bolt oil passage and a cap oil passage are formed in the press bolt and the cap, respectively, to connect the shaft variable oil passage with the piston oil passage.

7. The variable valve lift apparatus of claim 5, wherein the pin insertion hole has an inlet that is open to an outside of the valve bridge and a hole cap closes the inlet and supports the pin elastic member.

8. The variable valve lift apparatus of claim 1, wherein a guide groove is formed at a side surface of the variable piston, and a guide pin of which a front end portion is inserted into the guide groove to guide a movement of the variable piston along the guide groove, and wherein the guide pin is fixed in the valve bridge.

9. The variable valve lift apparatus of claim 1, wherein the at least one pin insertion hole includes two pin insertion holes, each disposed at one side of the piston insertion hole in a lengthwise direction of the valve bridge.

* * * * *